US007014129B2

(12) United States Patent
Dantes et al.

(10) Patent No.: US 7,014,129 B2
(45) Date of Patent: Mar. 21, 2006

(54) FUEL-INJECTION VALVE

(75) Inventors: Günter Dantes, Eberdingen (DE); Detlef Nowak, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 69 days.

(21) Appl. No.: 10/362,083

(22) PCT Filed: May 7, 2002

(86) PCT No.: PCT/DE02/01629

§ 371 (c)(1),
(2), (4) Date: Aug. 5, 2003

(87) PCT Pub. No.: WO03/001053

PCT Pub. Date: Jan. 3, 2003

(65) Prior Publication Data

US 2004/0099243 A1 May 27, 2004

(30) Foreign Application Priority Data

Jun. 22, 2001 (DE) ..... 101 30 206

(51) Int. Cl.
*F02M 59/00* (2006.01)

(52) U.S. Cl. ..... 239/533.2; 239/585.1; 239/585.5; 239/533.9; 239/533.12; 239/575

(58) Field of Classification Search ..... 239/533.2, 239/533.9, 533.12, 288.3, 288.5, 575, 590.3, 239/585.1, 585.2, 585.3, 585.4, 585.5, DIG. 23
See application file for complete search history.

(56) References Cited

U.S. PATENT DOCUMENTS

| | | | | |
|---|---|---|---|---|
| 4,030,668 | A * | 6/1977 | Kiwior | 239/585.4 |
| 5,707,012 | A * | 1/1998 | Maier et al. | 239/575 |
| 5,765,750 | A * | 6/1998 | Pace et al. | 239/5 |
| 6,837,449 | B1 * | 1/2005 | Dantes et al. | 239/533.12 |

FOREIGN PATENT DOCUMENTS

| | | |
|---|---|---|
| DE | 198 04 463 | 8/1999 |
| DE | 199 00 231 | 7/2000 |
| EP | 0 704 620 | 4/1996 |
| WO | 95 17595 | 6/1995 |

* cited by examiner

*Primary Examiner*—Dinh Q. Nguyen
(74) *Attorney, Agent, or Firm*—Kenyon & Kenyon

(57) ABSTRACT

A fuel injector for fuel-injection systems of internal combustion engines includes an actuator, a valve needle, which is able to be activated by the actuator to actuate a valve-closure member, which, together with a valve-seat surface formed at a valve-seat member, forms a sealing seat; and at least one spray-discharge orifice which is formed in the valve-seat member. At a downstream end of the fuel injector, a flameproofing screen is positioned, which shields the spray-discharge orifices from the combustion chamber of the internal combustion engine.

7 Claims, 2 Drawing Sheets

FUEL-INJECTION VALVE

BACKGROUND INFORMATION

From German Patent No. DE 198 04 463, a fuel-injection system for a mixture-compressing internal combustion engine having external ignition is known, which includes a fuel injector injecting fuel into a combustion chamber having a piston/cylinder design and has a spark plug projecting into the combustion chamber. The fuel injector includes at least one row of injection orifices distributed over the circumference of the fuel injector. By selectively injecting fuel via the injection orifices, a jet-directed combustion method is realized by a mixture cloud being formed using at least one jet.

Disadvantageous in the fuel injector known from the aforementioned publication, in particular, is the deposit formation in the spray-discharge orifices, these deposits clogging the orifices and causing an unacceptable reduction in the flow rate of the injector. This leads to malfunctions of the internal combustion engine.

SUMMARY OF THE INVENTION

The fuel injector according to the present invention has the advantage over the related art that a flameproofing screen, positioned downstream from the spray-discharge orifices, lowers the temperature of the flame front of the mixture cloud burning through in the area of the spray-discharge orifices to such a degree that no fuel is able to deposit at the valve-seat member, thereby avoiding a clogging of the spray-discharge orifices with coke residue.

The flameproofing screen is advantageously produced from wire netting and affixed to the valve-seat member with the aid of a mounting washer. The flameproofing screen may also be produced from sheet metal, into which orifices may be introduced by drilling, stamping or etching.

Moreover, it is advantageous that the mounting washer axially projects beyond the flameproofing screen in a discharge direction of the fuel, since this shields the flameproofing screen from the flow circulating in the combustion chamber and no fuel is able to deposit on the flameproofing screen.

DETAILED DESCRIPTION

Figure 1:
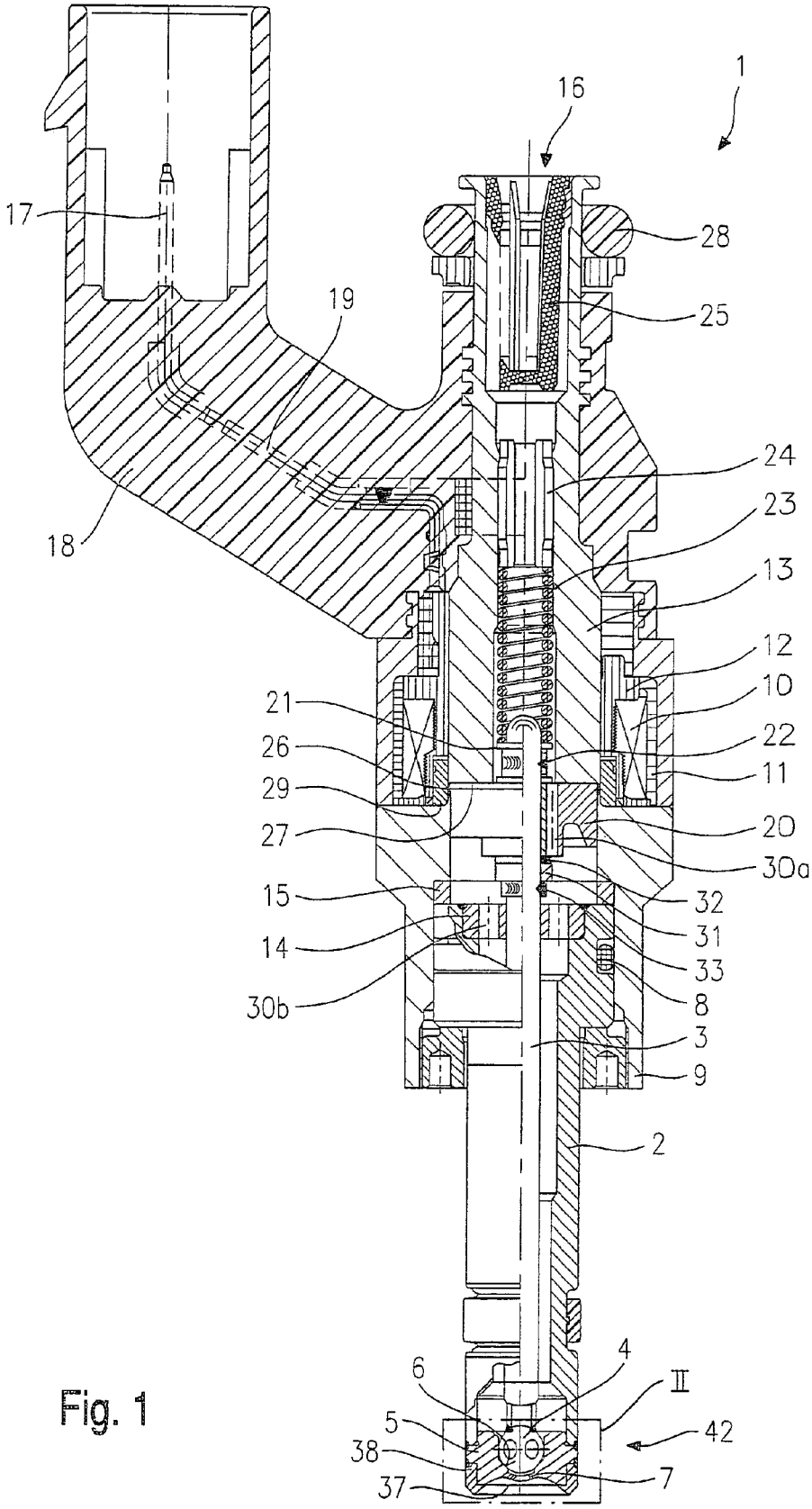
FIG. 1 shows a schematic section through an exemplary embodiment of a fuel injector configured according to the present invention, in an overall view.

In a part-sectional representation, FIG. 1 shows an exemplary embodiment of a fuel injector 1 designed according to the present invention. It is in the form of a fuel injector 1 for fuel-injection systems of mixture-compressing internal combustion engines having external ignition. Fuel injector 1 is suited for the direct injection of fuel into a combustion chamber (not shown) of an internal combustion engine.

Fuel injector 1 is made up of a nozzle body 2 in which a valve needle 3 is positioned. Valve needle 3 is in operative connection with a valve-closure member 4, for instance, via a welding seam 41, the valve-closure member 4 cooperating with a valve-seat surface 6, located on a valve-seat member 5, to form a sealing seat. In the exemplary embodiment, fuel injector 1 is an inwardly opening fuel injector 1, which has two spray-discharge orifices 7.

Valve-closure member 4 of fuel injector 1 designed according to the present invention has a nearly spherical form, thereby achieving an offset-free, cardanic valve-needle guidance, which provides for a precise functioning of fuel injector 1.

Valve-seat member 5 of fuel injector 1 has a cup-shaped design, for example, and contributes to the valve-needle guidance by its form. Valve-seat member 5 is inserted into a discharge-side recess 34 of nozzle body 2 and joined to nozzle body 2 by a welding seam 35.

Seal 8 seals nozzle body 2 from an outer pole 9 of a magnetic coil 10 functioning as an actuator for valve needle 3. Magnetic coil 10 is encapsulated in a coil housing 11 and wound on a coil brace 12, which rests against an inner pole 13 of magnetic coil 10. Inner pole 13 and outer pole 9 are separated from one another by a gap 26 and are braced against a connecting member 29. Magnetic coil 10 is energized via a line 19 by an electric current, which may be supplied via an electrical plug contact 17. A plastic coating 18, which may be extruded onto inner pole 13, encloses plug contact 17.

Valve needle 3 is guided in a valve-needle guide 14, which is disk-shaped. A paired adjustment disk 15 is used to adjust the (valve) lift. On the other side of adjustment disk 15 is an armature 20 which, via a first flange 21, is connected by force-locking to valve needle 3, which is connected to first flange 21 by a welding seam 22. Braced against first flange 21 is a restoring spring 23 which, in the present design of fuel injector 1, is prestressed by a sleeve 24.

On the discharge-side of armature 20 is a second flange 31 which is used as lower armature stop. It is connected via a welding seem 33 to valve needle 3 in force-locking manner. An elastic intermediate ring 32 is positioned between armature 20 and second flange 31 to damp armature bounce during closing of fuel injector 1.

Fuel channels 30*a* and 30*b* run in valve-needle guide 14 and in armature 20. The fuel is supplied via a central fuel feed 16 and filtered by a filter element 25. Beveled sections 36 assume the fuel supply to the sealing seat in the area of valve-seat member 5. A seal 28 seals fuel injector 1 from a distributor line (not shown further).

According to the present invention, fuel injector 1 is provided with a flameproofing screen at valve-seat member 5 positioned in a recess 34 of nozzle body 2 and connected thereto by a welding seam 35, for example. The flameproofing screen is mounted downstream from spray-discharge orifices 7 by a mounting washer 38. By its placement on the discharge side of spray-discharge orifices 7, it reduces the coking tendency, thereby preventing malfunctions of fuel injector 1 due to clogging of spray-discharge orifices 7, as well as an unacceptable reduction in the fuel flow. The discharge-side part of fuel injector 1 with the measures according to the present invention is illustrated and explained in greater detail in FIG. 2.

In the rest state of fuel injector 1, restoring spring 23 acts upon first flange 21 at valve needle 3, contrary to a lift direction, in such a way that valve-closure member 4 is sealingly retained against valve seat 6. Armature 20 rests on intermediate ring 32, which is supported on second flange 31. In response to excitation of magnetic coil 10, it builds up a magnetic field which moves armature 20 in the lift direction, against the spring force of restoring spring 23. Armature 20 carries along first flange 21, which is welded to valve needle 3, and thus valve needle 3, in the lift direction as well. Valve-closure member 4, being in operative connection with valve needle 3, lifts off from valve seat surface 6, thereby discharging fuel at spray-discharge orifices 7.

When the coil current is turned off, once the magnetic field has sufficiently decayed, armature 20 falls away from internal pole 13, due to the pressure of restoring spring 23 on first flange 21, whereupon valve needle 3 moves in a direction counter to the lift. As a result, valve closure member 4 comes to rest on valve-seat surface 6, and fuel injector 1 is closed. Armature 20 comes to rest against the armature stop formed by second flange 31.

Figure 2:
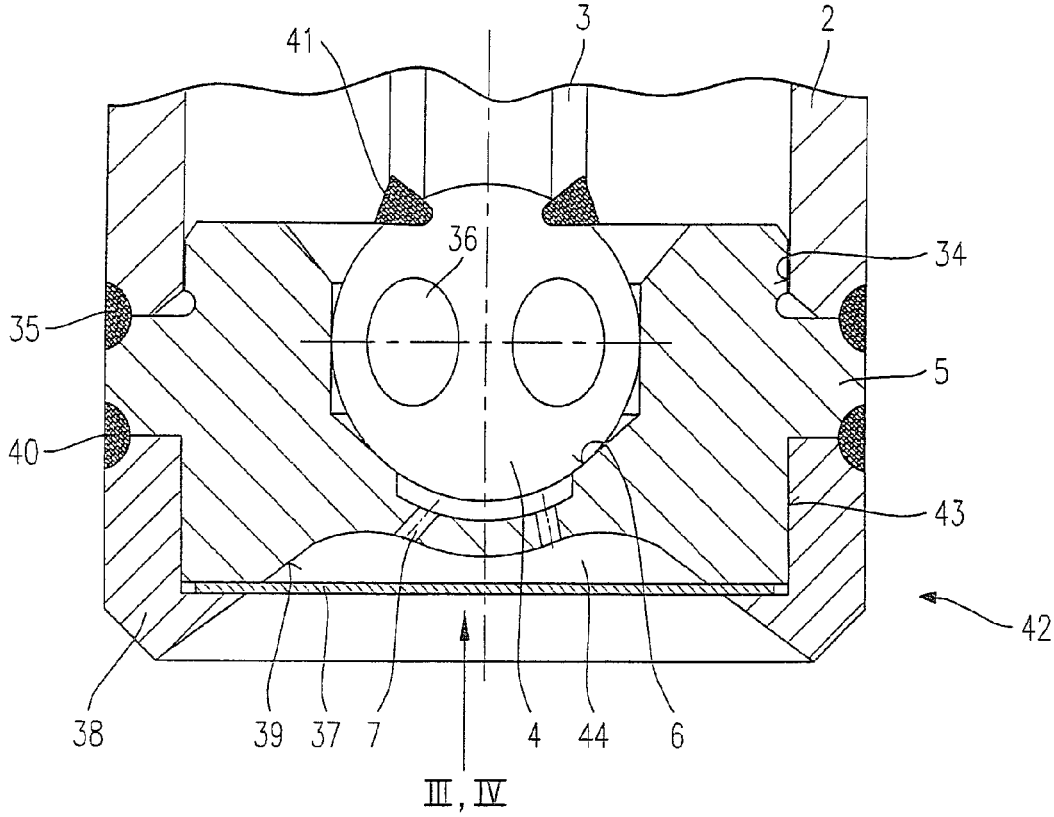
FIG. 2 shows a schematic section through the discharge-side part of the exemplary embodiment, shown in FIG. 1, of the fuel injector designed according to the present invention, in region II in FIG. 1.

In a part-sectional view, FIG. 2 shows the cut-away portion, designated II in FIG. 1, from the exemplary embodiment of a fuel injector 1 designed according to the present invention, as represented in FIG. 1.

As already sketched in FIG. 1, valve-seat member 5, in the exemplary embodiment, is provided with a mounting washer 38 at an outer end face 39 facing the combustion chamber (not shown further), by which a flameproofing screen 37 is fixed in place at the downstream side of valve-seat member 5. The mounting washer may be affixed to valve-seat member 5 by a welding seam 40, for instance, and is supported at a shoulder 43 of valve-seat member 5.

By placing flameproofing screen 37 downstream from spray-discharge orifices 7, coke deposits on spray-discharge orifices 7 may be reduced. Since the diameter of spray-discharge orifices 7, typically, amounts to approximately 100 $\mu$m, the danger of spray-discharge orifices 7 becoming clogged over time and the flow rate being restricted to an unacceptable degree, due to the formation of deposits, is relatively high. This is the result, in particular, of the high temperatures during the through-ignition of the mixture cloud injected into the combustion chamber, since fuel components are thereby deposited on the tip of fuel injector 1. By the mounting of flameproofing screen 37, the surface temperature in the discharge region of spray-discharge orifices 7 may be reduced to such a degree that spray-discharge orifices 7 are unable to become clogged by coking residue. In this manner, flameproofing screen 37 which, therefore, has a flameproofing function, prevents the flame front from spreading to the area between flameproofing screen 37 and valve-seat member 5.

The afore-mentioned flameproofing function of flameproofing screen 37 may be enhanced by an appropriate design of valve-seat member 5 and mounting washer 38. As explained earlier, the flameproofing screen seals the discharge region of spray-discharge orifices 7 from the combustion chamber, thereby delimiting it from a spray-discharge region 44. Mounting washer 38 is formed such that it continues the form of valve-seat member 5 in the region of spray-discharge area 44 in the spray-discharge direction, so that a funnel-shaped form of the spray-discharge region results overall.

Moreover, mounting washer 38 projects beyond flameproofing screen 37 in the axial direction, so that, in addition to the flameproofing function of flameproofing screen 37, mounting washer 38 also assumes a screening function with respect to downstream-side end 42 of fuel injector 1, since it shields flameproofing screen 37 from the combustion-chamber flows which circulate in the combustion chamber tangentially to fuel injector 1.

Figure 3:
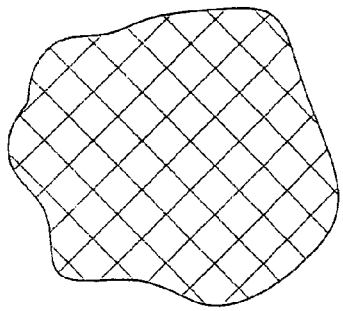
FIG. 3 shows a plan view of the flameproofing screen in a viewing direction III in FIG. 2.
Figure 4:
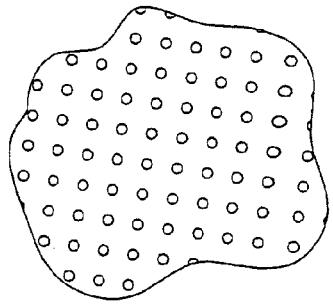
FIG. 4 shows a plan view of the flameproofing screen in a viewing direction IV in FIG. 2 according to a modified exemplary embodiment.

As represented in FIG. 3, flameproofing screen 37 is preferably made of a mesh of metal wire; however, it is also conceivable to provide orifices in an appropriately formed sheet metal, as shown in FIG. 4, by drilling, stamping or etching, for instance.

The present invention is not limited to the exemplary embodiments shown, but is also able to be applied to arbitrary designs of fuel injectors 1.

What is claimed is:

1. A fuel injector for the direct injection of fuel into a combustion chamber of an internal combustion engine, comprising:

a valve-seat member;

a valve-seat surface situated at the valve-seat member;

a valve-closure member which, together with the valve-seat surface, forms a sealing seat;

a valve needle;

an actuator for activating the valve needle to actuate the valve-closure member;

at least one spray-discharge orifice situated in the valve-seat member;

a flameproofing screen situated at a downstream end of the fuel injector, the flameproofing screen shielding the at least one spray-discharge orifice from the combustion chamber of the internal combustion engine; and a mounting washer mounting the screen at the downstream end of the fuel injector, wherein the mounting washer is supported at a shoulder of the valve-seat member.

2. The fuel injector according to claim 1, wherein the mounting washer is affixed to the valve-seat member by a welding seam.

3. The fuel injector according to claim 1, wherein the screen delimits a spray-discharge area between the valve-seat member and the screen from the combustion chamber.

4. The fuel injector according to claim 1, wherein the screen is composed of a mesh of metal wire.

5. The fuel injector according to claim 1, wherein the screen is composed of sheet metal containing orifices.

6. The fuel injector according to claim 5, wherein the orifices are introduced into the sheet metal by one of stamping, drilling and etching.

7. The fuel injector according to claim 1, wherein the mounting washer axially projects beyond the screen in a discharge direction.

* * * * *